United States Patent [19]

Smith et al.

[11] 4,278,008

[45] Jul. 14, 1981

[54] SEPARATE LOADING AMMUNITION AUTOMATIC CANNON

[75] Inventors: William G. Smith, Burns, Tenn.; Ladd Yuhash, Morris Township, Morris County, N.J.

[73] Assignee: The United States of America as represented by the Secretary of the Army, Washington, D.C.

[21] Appl. No.: 84,249

[22] Filed: Oct. 12, 1979

[51] Int. Cl.[3] ..... F41D 7/02

[52] U.S. Cl. ..... 89/156; 89/186

[58] Field of Search ..... 42/15, 39.5; 89/4 B, 89/9, 11, 24, 33 ML, 155, 156, 167, 173, 186, 187 R

[56] References Cited

U.S. PATENT DOCUMENTS 3,474,560 10/1969 Ramsay ..... 42/15

*Primary Examiner*—Stephen C. Bentley

*Attorney, Agent, or Firm*—Nathan Edelberg; Robert P. Gibson; A. Victor Erkkila

[57] ABSTRACT

A cartridge containing a propellant charge, and a separate projectile are individually loaded into two independently operable sections of a gun breech assembly. The automatic loading operation is facilitated by separating the two sections during recoil movement, loading each component, and re-aligning both sections with the gun barrel in the battery position at the conclusion of counter-recoil movement.

10 Claims, 6 Drawing Figures

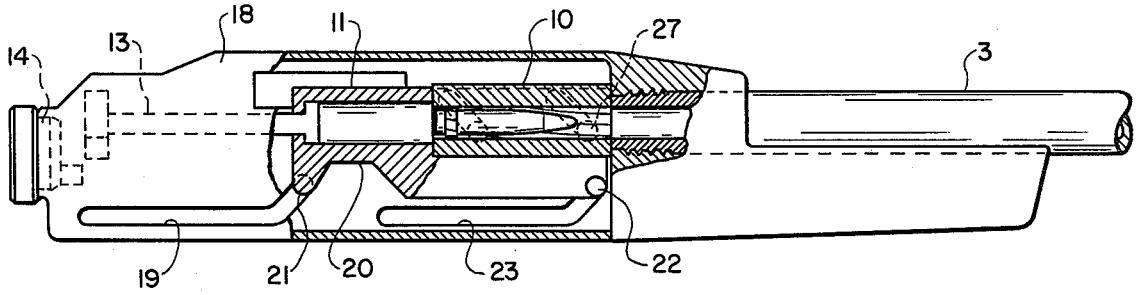
FIG. 2
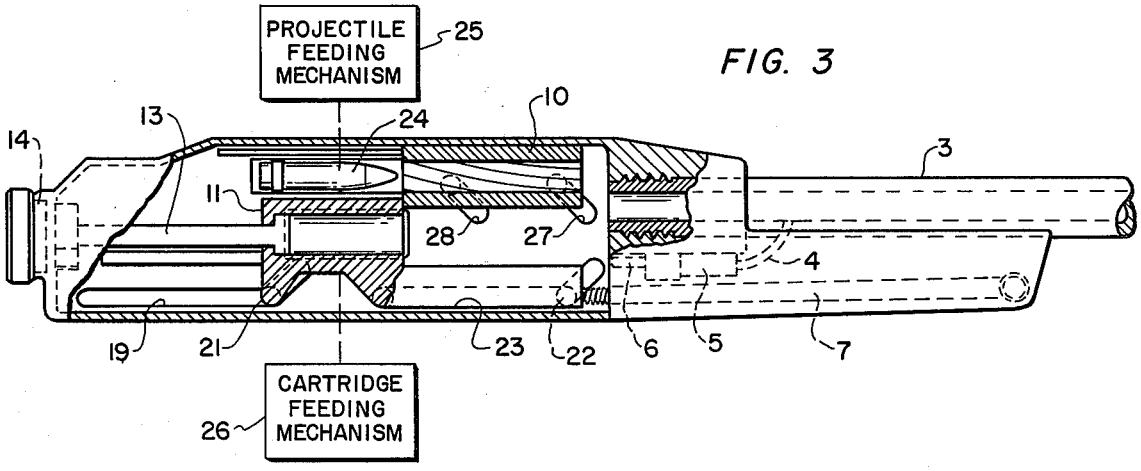
FIG. 3
FIG. 4
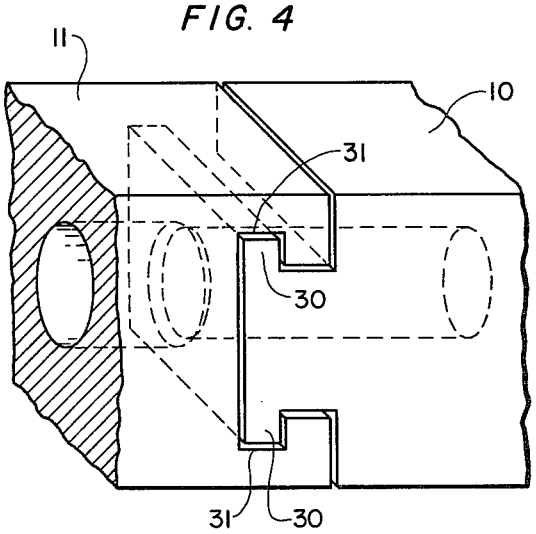
FIG. 5
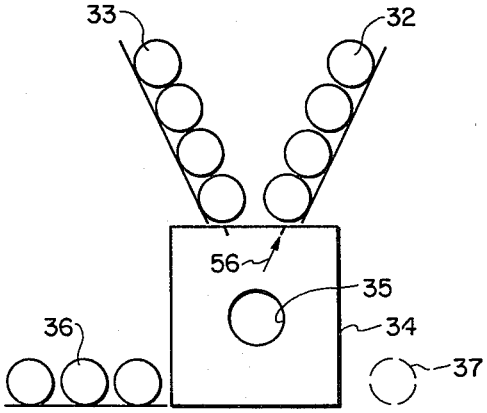

SEPARATE LOADING AMMUNITION AUTOMATIC CANNON

The invention described herein may be manufactured, used and licensed by or for the Government for governmental purposes without the payment to us of any royalties thereon.

BACKGROUND OF THE INVENTION

This invention relates to automatic cannon, and more particularly to an automatic cannon which has many advantages compared to prior art cannons of its caliber range. The invention involves a novel mechanism by means of which separate loading ammunition may be rapidly and efficiently automatically loaded and fired. Prior art separate loading ammunition cannons have traditionally been of the semi-automatic or manual loading type. Thus this invention comprises a significant step forward in the art, in that it substantially increases firepower compared to comparable weapons in the prior art.

SUMMARY OF THE INVENTION

The novel cannon is intended primarily to accommodate projectiles in the 20 mm to 50 mm caliber range, however the principles of operation may be applicable to both larger or smaller firearms. Cannons in this caliber range find wide use in the military, and continuing research is being carried on in order to improve the performance, efficiency, firepower, and economics of such weapons. The present invention accomplishes improvements in all of these areas.

Briefly stated, the present invention comprises a cannon including a main relatively fixed barrel with a moveable floating barrel and a moveable chamber arranged to be axially aligned therewith during the battery or firing position of the weapon. After firing, the floating barrel is arranged to be moved laterally relative to the fixed barrel, and the chamber is also arranged to be moved laterally relative to the fixed barrel, but in the opposite direction. Thus one of these moveable elements may be moved to the left after firing and the other to the right, or one upward and the other downward. The lateral movement of the barrel and chamber facilitates the automatic ejection of the spent cartridge case and the automatic loading of the projectile and a new cartridge.

The use of separate loading ammunition has numerous advantages. The use of a separate cartridge containing only the charge and igniter permits the use of a consolidated or solid charge which has a higher energy content per unit volume than conventional powder-type charges utilized in convention one-piece ammunition. Thus the charge volume can be reduced to achieve a given muzzle velocity with a given size and weight projectile. Also, while separate automatic loading mechanisms are required, both are smaller and require less total operating energy than the single system using conventional ammunition. Further, the reduced length of each of the separate ammunition components, which are loaded simultaneously, results in a shorter ram stroke required to insert the projectile and cartridge in the gun mechanism. This feature results in a substantially shorter weapon, more volumetic efficiency, and substantially higher rates of fire. In accordance with a further novel and advantageous feature of the present invention, after the aforementioned lateral separation of the floating barrel and the chamber, both of these elements are moved in unison to the rear. This results in an even shorter ram stroke since the floating barrel is arranged, as to move rearward, to envelope the projectile which has been positioned by the automatic loading system. Also, the firing assembly to the rear of the chamber is arranged to automatically eject the spent cartridge case in response to the same rearward movement of the floating barrel and chamber.

In accordance with another feature of this invention the cartridge case, which is of generally cylindrical shape, is formed of metal or plastic and includes a front frangible plastic seal which is held in place by a forward lip integral with the case. Upon firing, the forward lip is forced outward by the expanding gases and forms an annular seal which aids in preventing gas escape at the junction of the chamber and floating barrel. The chamber, of course, must be locked to the main barrel during firing but the floating barrel has at its forward edge a tapered section which mates with an oppositely tapered section in the rear edge of main barrel. The pressure of the exploding gases forces the floating barrel against the main barrel and the tapered sections thereof provide precision alignment and positive pressure between the two barrels, thus preventing leakage at this junction.

Other novel features and advantages of the invention will become apparent from the following detailed description and the drawings.

BRIEF DESCRIPTION OF THE DRAWINGS

FIGS. 2 and 3 show additional details of the novel cannon, in particular these figures illustrate one form of cam which can be used to activate the moveable parts of the cannon.

FIG. 4 illustrates one means by which the floating barrel and the chamber may be mechanically connected so that they can slide laterally with respect to each other and simultaneously move forward and backward in unison.

FIG. 5 illustrates how a dual automatic projectile feed system may be utilized with the present invention.

DETAILED DESCRIPTION OF A PREFERRED EMBODIMENT

Figure 1:
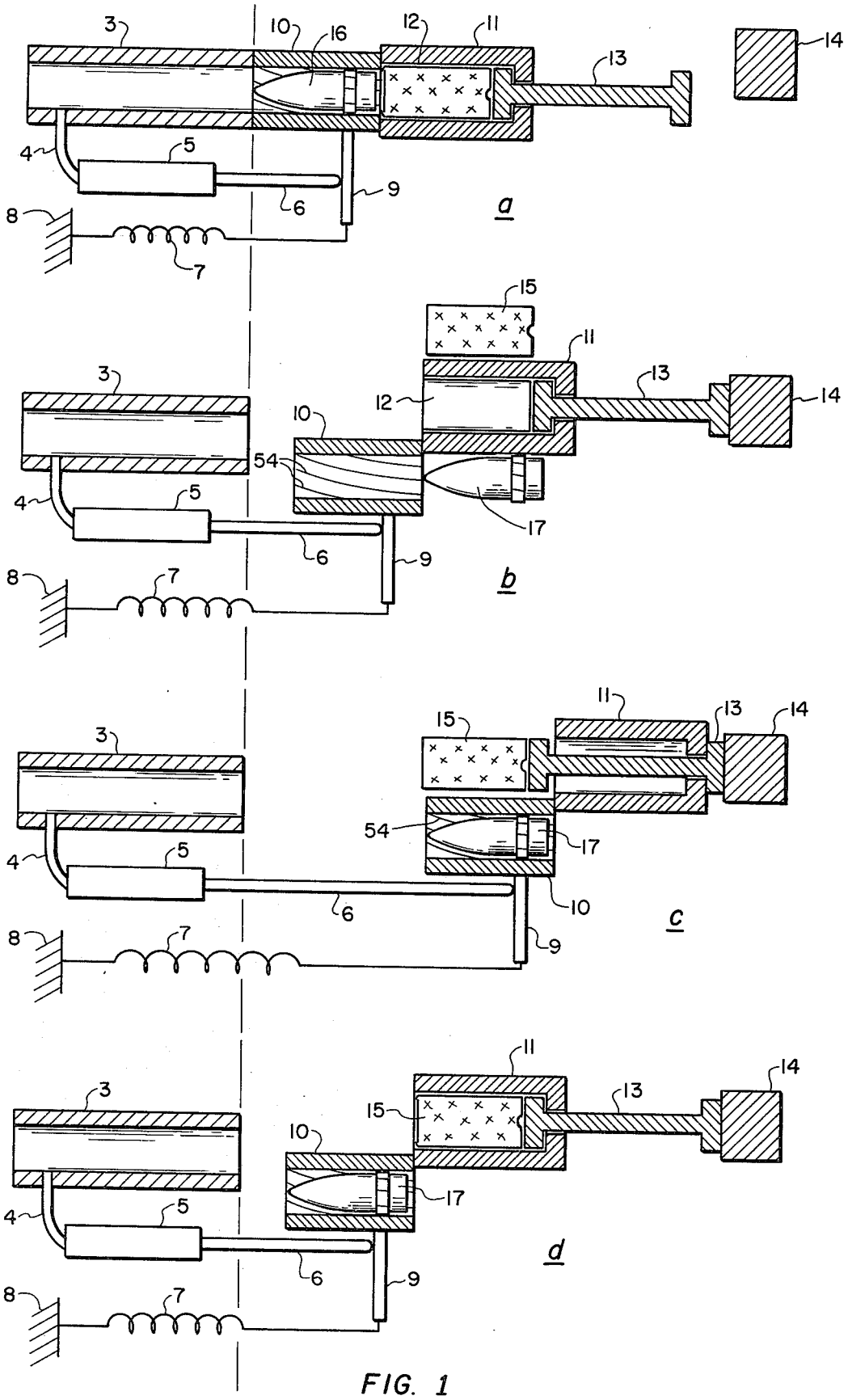
FIG. 1 is a schematic drawing illustrating the concept of operation of the invention in various phases of its operation.
Figure 6:
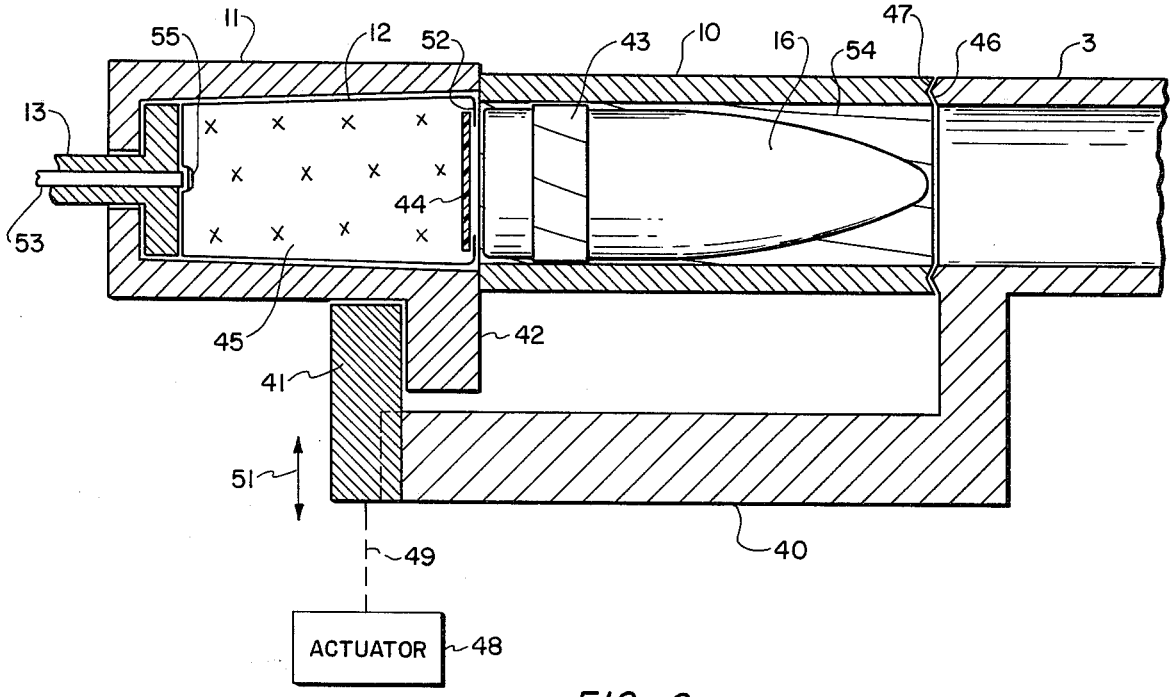
FIG. 6 illustrates a round of separate loading ammunition in the novel cannon ready to be fired and illustrates the chamber locked to the main barrel with the moveable floating barrel between them.

In FIG. 1 the main cannon barrel 3 is smooth-bored and is fixed relative to the moveable floating barrel 10 and the cup-like chamber 11. The barrel 10 is rifled and is just long enough to accommodate the projectile 16, while the chamber 11 is designed to receive the cartridge 12. The chamber 11 has the firing assembly 13 projecting into its aft or rear end, as illustrated. Firing assembly 13 includes an appropriate firing mechanism, for example a firing pin centrally projecting therethrough and arranged to strike an igniter at the base of the cartridge. The firing pin and igniter are illustrated in FIG. 6 but are not shown in FIG. 1. The buffer 14 is fixedly mounted to the gun chassis or receiver and serves as a stop for the rear or right end of the firing mechanism. A gas cylinder and piston system 5 is shown connected by means of tube 4 to the main barrel 3 to actuate the moving parts after firing to accomplish the automatic ejection and re-loading functions. The pushrod 6 is actuated by a piston within cylinder 5 and pushes against post 9 attached to moveable barrel 10 in order to urge it to the rear, or right. A return spring 7 is also connected to post 9 to urge it and all the parts connected thereto to the left during counter-recoil movement, after actuation by the gas cylinder. The spring 7 is anchored to a relatively fixed point on the cannon, as indicated at 8.

In FIG. 1*a* the cannon is shown in the battery position ready to be fired. In this position the chamber is locked to the main barrel, as illustrated in FIG. 6.

FIG. 1*b* illustrates the unlocking of the moveable barrel and chamber which occurs just after firing as the pushrod 6 urges the moveable barrel and the chamber to the rear. The moveble barrel and the chamber move in unison forward and backward since they are connected at their junction by a mechanism such as a key and keyway, as illustrated in FIG. 4. Such a means of connection permits these two moveable parts to slide laterally relative to each other, that is in opposite directions, but forces them to translate longitudinally, or to the right and left as seen in FIG. 1, in unison. The lateral movement of the barrel 10 and chamber 11 is accomplished by means of cams fixedly mounted to the cannon chassis and mating cam followers attached to the moveable parts. Such a cam system is illustrated in FIGS. 2 and 3.

It would have been possible to design this cannon so that only either the barrel or chamber would have moved laterally, but for twice the distance. This would have provided some simplification, however it has the disadvantage of a sidewise recoil at the end of the lateral movement, which could shift the entire cannon a slight amount and produce undesirable dispersion in its firing pattern. With two parts moving in opposite directions simultaneously, there is a balance of the reactive forces which minimizes any sidewise recoil. In FIG. 1*b* the projectile of the next round 17 is shown in position ready to be loaded into barrel 10. The automatic loading and ejection system contemplated for use in this weapon would be any suitable such system from the prior art and thus would not be novel per se. For this reason it is only indicated schematically, as in FIG. 3. Again referring to FIG. 1*b*, the spent cartridge case 12 is shown still in chamber 11. At this point the aft end of firing assembly 13 has just contacted buffer 14. Further recoil movement of the chamber and barrel causes the now stationary firing assembly to push the spent cartridge case out of the chamber. When it is completely out it will be forced through a suitable opening by the next incoming cartridge. As can also be seen in FIG. 1*c*, the further recoil movement of the moveable barrel 10 causes the stationary projectile 17 of the next round to be inserted therein. The automatic loading system then positions a new cartridge 15 in front of the retracted chamber while simultaneously ejecting the spent cartridge case so that on its return stroke, under the influence of spring 7, the new cartridge will be inserted into the chamber, as shown in FIG. 1*d*. Further counter-recoil movement to the left under the influence of spring 7 will bring the loaded weapon to the battery position of FIG. 1*a*.

FIG. 2 also shows the weapon in the battery position and illustrates one form of cam system which can be used to achieve the desired lateral motion of the moveable barrel and chamber. The parts in FIG. 2 and all subsequent figures have been given the same reference numbers as the same part bears in FIG. 1. In the partially broken away view and partially sectional view of FIG. 2, the illustrated cannon includes a receiver side plate 18 in which are two cams 19 and 23 in the form of slots of dog leg shape. The chamber 11 includes a depending skirt or flange 20 which has fixedly attached thereto two pins or rollers 21 and 22 which are adapted to slide in the slots 19 and 23. Thus the illustrated cam system will move the chamber first downward and thence to the rear or to the left in FIG. 2. Another receiver side plate on the opposite side of the weapon would have another set of slots and another flange and roller connected to the floating barrel 10, and arranged to move the floating barrel upward and to the rear as the pushrod 6 actuates the system following firing. FIG. 3 shows two such slots 27 and 28 used to move the floating barrel 10 upward and then to the rear. FIG. 3 illustrates the weapon just following firing and corresponds to FIG. 1*b*. FIG. 3, in addition shows schematically a projectile feeding system 25 and a cartridge feeding system 26 arranged respectively above and below the weapon and operatively connected thereto. FIG. 3 also shows the gas piston system 5 and 6 and the spring 7. These would be connected to the floating barrel as indicated in FIG. 1.

FIG. 4 shows how the floating barrel 10 and the chamber 11 may be linked by means of a key and keyway arrangement so that these two parts may move longitudinally or to the rear in unison, but are free to slide sidewise or laterally under the influence of the cams shown in FIGS. 2 and 3. In order to accommodate the key and keyway, the floating barrel and the chamber would have square exterior shapes as shown in FIG. 4. The keys 30, comprise a pair of projections on the top and bottom of the rear edge of the barrel 10, and would slideably mate with corresponding notches or keyways 31 in the top and bottom of the forward edge of the chamber 11.

FIG. 5 shows in schematic fashion how a weapon of this design can be arranged with a dual projectile feed system so that one or the other of two types of projectiles may be selectively fired. The two types of projectiles may, for example, be armour-piercing or incendiary, enabling the gunner to select one or the other depending on the target presented. The weapon chassis is indicated at 34 in the drawing, either from the front or rear, the main barrel being indicated at 35. Two automatic loading mechanisms 32 and 33 are indicated for two types of projectiles, with a switch 56 arranged so that the gunner can select either one. The cartridge feeding system is indicated at 36, with 37 representing a spent cartridge case.

FIG. 6 cartridge 12 includes an igniter 55 at its aft end and is filled with a consolidated charge indicated at 45. The cartridge case is generally cylindrical in shape resembling a metallic cup, but with lip 52 bent over to partially close its forward end. The lip 52 engages a frangible plastic seal 44, which contains the charge prior to firing. Upon firing the lip 52 is forced outward and into the rear end of the floating barrel section 10, thus aiding in preventing the escape of gas at this junction. FIG. 6 also shows how the chamber 11 may be locked to the main barrel 3 during firing. Integral with and extending from the rear of the main barrel 3 is a bracket 40 on which is mounted a slideable bolt 41 which is adapted to slide upward to engage a projection 42 forming part of chamber 11. Actuator 48, shown mechanically linked at 49 to bolt 41 forms a part of the automatic feeding system and is arranged to raise or lock bolt 41 when the weapon is ready to fire, and to unlock it immediately after firing to permit the rearward motion of the chamber and floating barrel.

In FIG. 6 the projectile 16 is shown in the floating barrel 10, ready for firing. The rotating band 43 on the projectile engages the helical lands and grooves 54 of the rifled floating barrel so that a stabilizing spin is imparted to the projectile. In accordance with another feature of this invention, the main barrel 3 may have a smooth bore and the rifling 54 of the floating barrel is arranged with a pitch to "overspin" the projectile as it enters the main barrel. The decay in the spin while the projectile traverses the main barrel then produces the desired spin at the muzzle. With such a feature, when the lands and grooves of the floating barrel become worn, this short barrel can be replaced without replacing the smooth-bore main barrel.

Again referring to FIG. 6, the rear end of the main barrel is seen to have a convex tapered section 46 which is arranged to mate with a corresponding concave tapered section 47 at the forward end of the floating barrel. This arrangement facilitates alignment of the floating barrel and main barrel upon firing and aids in preventing gas leakage at this point. As illustrated in the drawings the internal diameter of the chamber is larger than that of the floating barrel. With this design, the substantial pressure developed in the cartridge upon firing causes the cartridge lip 52 to expand forward against the rear of the floating barrel, forcing the floating barrel forward into close and firm sealing contact and alignment with the main barrel with the aid of the precision machined and mated tapered sections 46 and 47. The drag of the rotating band 43 as it engages the floating barrel rifling 54 produces additional force urging the floating barrel forward. In order to allow this alignment action to take place, the key and keyway arrangement of FIG. 4 which connects the "floating" barrel to the chamber is deliberately designed with sufficient play or clearance in its mating parts, so that alignment can be effected by the mating tapered sections 46 and 47, as explained above.

FIG. 6 also shows the firing pin 53 projecting through firing assembly 13 and arranged to strike igniter 55 to initiate firing.

Although the invention has been described with particular reference to a preferred embodiment, it should be understood that the invention is not limited thereto, and that various modifications are possible without departing from the spirit and scope of the invention as defined by the following claims.

We claim:

1. An automatic cannon adapted for separate loading ammunition including a separate projectile and a propellant cartridge, which comprises:

a relatively fixed main barrel;

a floating barrel adapted to receive the projectile of said ammunition;

a moveable chamber adapted to receive the propellant cartridge of said ammunition, said chamber and floating barrel being coaxially positioned with said main barrel in the battery position;

first means for connecting the forward end of said chamber to the rear end of said floating barrel to enable longitudinal movement thereof in unison while permitting lateral movement of the chamber and the floating barrel relative to each other;

second means, responsive to the firing of said cannon, for moving said chamber and said floating barrel in unison rearwardly relative to the main barrel and said chamber and said floating barrel laterally relative to each other, so as to permit the removal of the spent cartridge case from said chamber and the reloading of a new cartridge case into said chamber, and a new projectile into said floating barrel;

third means for automatically reloading said floating barrel with a new projectile and said chamber with a new cartridge case while said floating barrel and said chamber are laterally displaced relative to each other; and fourth means for returning said chamber and floating barrel to the battery position after reloading.

2. The cannon of claim 1 including further means to lock said chamber to said main barrel prior to firing and to release said chamber from said main barrel after firing.

3. The cannon of claim 1 wherein said second means comprises a cam system connected to said floating barrel and to said chamber for moving said floating barrel and said chamber laterally in opposite directions.

4. The cannon of claim 3 wherein said second means further comprises a gas piston energized by gases bled from said main barrel upon firing for moving said floating barrel and chamber rearwardly and laterally and wherein said fourth means comprises a spring for moving said floating barrel and said chamber back to the battery position following automatic reloading.

5. The cannon of claim 1 wherein said floating barrel is rifled and said main barrel is of smooth bore, and wherein the rifling on said floating barrel is designed to produce a desired stabilizing spin to the fired projectile at the muzzle of said main barrel.

6. The cannon of claim 1, in which the forward end of said floating barrel and the rear end of said main barrel includes mating precision-machined/tapered sections and said chamber has a larger internal diameter than said floating barrel, whereby, upon firing the gas pressure in said chamber acting against the rear end of said floating barrel will force said floating barrel forward into firm, sealing contact with said main barrel, thus eliminating gas leakage at the juncture of said floating barrel and said main barrel and aligning these two barrels.

7. The cannon of claim 6 wherein said second means comprises a key and keyway connecting said floating barrel to said chamber in such a way that these two components can move laterally with respect to each other, but will move forward and aft in unison, said key and keyway being designed with sufficient play in its mating parts to permit said tapered sections to effect alignment of said floating barrel and said main barrel upon firing.

8. The cannon of claim 1 wherein said separate loading ammunition comprises a cartridge including an igniter, a consolidated charge and a rigid cartridge case of generally cylindrical shape with its front end sealed with a frangible seal held in place by a bent-over lip integral with said cartridge case, whereby, upon firing, said lip will expand forward to seal the joint between said floating barrel and said chamber, and wherein said separate loading ammunition further includes a projectile, which may be of any selected type depending on the mission involved.

9. The cannon of claim 1 in which said third means comprises a dual projectile reloading system, whereby one of two types of projectiles may be selectively reloaded.

10. A cannon adapted for automatic loading of separate cartridges and projectiles, comprising:

a relatively fixed main barrel with a floating barrel arranged aft of said main barrel in the battery position;

a chamber arranged aft of said floating barrel in said battery position;

gas piston means responsive to the firing of said cannon arranged to move said floating barrel and said chamber laterally or sidewise in opposite directions relative to said main barrel and also to move said floating barrel and chamber in unison to the rear relative to said main barrel;

automatic loading means arranged to eject the spent cartridge case and reload a new cartridge into said chamber and a new projectile into said floating barrel during their rearward movement;

retractile spring means to return said loaded floating barrel and said chamber to the battery position; and means to lock said chamber to said main barrel prior to firing and to release said chamber from said main barrel after firing.

* * * * *